US010487985B2

(12) United States Patent
Tjørhom

(10) Patent No.: US 10,487,985 B2
(45) Date of Patent: Nov. 26, 2019

(54) TANK SYSTEM

(71) Applicant: Z Holding AS, Sandnes (NO)

(72) Inventor: Sven Egil Tjørhom, Sandnes (NO)

(73) Assignee: Z Holding AS, Sandnes (NO)

( * ) Notice: Subject to any disclaimer, the term of this patent is extended or adjusted under 35 U.S.C. 154(b) by 169 days.

(21) Appl. No.: 15/526,167

(22) PCT Filed: Nov. 11, 2015

(86) PCT No.: PCT/EP2015/076297
§ 371 (c)(1),
(2) Date: May 11, 2017

(87) PCT Pub. No.: WO2016/075186
PCT Pub. Date: May 19, 2016

(65) Prior Publication Data

US 2018/0306384 A1 Oct. 25, 2018

(30) Foreign Application Priority Data

Nov. 13, 2014 (NO) ..... 20141365

(51) Int. Cl.
*F17C 13/08* (2006.01)
*F17C 1/00* (2006.01)
*F17C 3/00* (2006.01)

(52) U.S. Cl.
CPC ..... *F17C 13/08* (2013.01); *F17C 1/00* (2013.01); *F17C 3/00* (2013.01);
(Continued)

(58) Field of Classification Search
CPC ..... F17C 3/00; F17C 2223/033; F17C 2203/0643; F17C 2203/0673;
(Continued)

(56) References Cited

U.S. PATENT DOCUMENTS 2,087,300 A * 7/1937 Ragonnet ..... B60P 3/222 222/6
5,228,821 A * 7/1993 Gleffe ..... B65D 19/12 108/53.1
(Continued)

FOREIGN PATENT DOCUMENTS

CA 2619895 A1 3/2005
EP 1452794 A2 9/2004
(Continued)

OTHER PUBLICATIONS

International Search Report issued in corresponding application No. PCT/EP2015/076297 dated Sep. 16, 2016 (2 pages).
(Continued)

*Primary Examiner* — Umashankar Venkatesan
(74) *Attorney, Agent, or Firm* — Christian D. Abel

(57) ABSTRACT

A modular tank system includes at least two pressure tanks and a mounting frame. Each of the tanks includes a pressure vessel and a protection frame within which the vessel is arranged, the protection frame is adapted such that multiple tanks may be mounted on top of each other and the vessel includes a vent outlet and an inlet, where the outlet is arranged in an upper half of the vessel, the inlet is arranged in a lower half of the vessel and is fluidly connected to a tank process line, which includes a first fluid connector and a second fluid connector on opposite ends of the tank process line, such that the second connector of a first tank is connectable to the first connector of a second tank, when the second tank is mounted on top of the first tank; and the mounting frame includes a base frame.

5 Claims, 12 Drawing Sheets

(52) U.S. Cl.
CPC ..... *F17C 2201/0109* (2013.01); *F17C 2201/032* (2013.01); *F17C 2201/054* (2013.01); *F17C 2203/066* (2013.01); *F17C 2203/0643* (2013.01); *F17C 2203/0663* (2013.01); *F17C 2203/0673* (2013.01); *F17C 2205/0107* (2013.01); *F17C 2205/0142* (2013.01); *F17C 2205/0146* (2013.01); *F17C 2205/0169* (2013.01); *F17C 2205/0326* (2013.01); *F17C 2205/0329* (2013.01); *F17C 2205/0341* (2013.01); *F17C 2205/0379* (2013.01); *F17C 2221/032* (2013.01); *F17C 2223/0153* (2013.01); *F17C 2223/033* (2013.01); *F17C 2223/035* (2013.01); *F17C 2223/043* (2013.01); *F17C 2223/046* (2013.01); *F17C 2250/043* (2013.01); *F17C 2250/0408* (2013.01); *F17C 2260/018* (2013.01); *F17C 2260/044* (2013.01); *F17C 2270/0118* (2013.01); *Y10T 137/474* (2015.04)

(58) Field of Classification Search
CPC ..... F17C 2205/0379; F17C 2203/066; F17C 2250/043; F17C 2223/0153; F17C 2205/0329; F17C 2223/046; F17C 2223/043; F17C 2260/044; F17C 2221/032; F17C 2203/0663; F17C 2260/018; F17C 2205/142; F17C 2250/0408; F17C 2223/035
See application file for complete search history.

(56) References Cited

U.S. PATENT DOCUMENTS

| | | | | |
|---|---|---|---|---|
| 6,502,660 | B1 | 1/2003 | Scott et al. | |
| 8,079,791 | B2 * | 12/2011 | Ness | B65D 88/123 410/31 |
| 9,517,815 | B1 * | 12/2016 | Altman | B63B 3/56 |
| 10,093,451 | B2 * | 10/2018 | Blitz | B65D 71/0096 |
| 2002/0171236 | A1 | 11/2002 | Joitescu et al. | |
| 2004/0159352 | A1 * | 8/2004 | Friedlmeier | F17C 1/00 137/266 |
| 2004/0226607 | A1 * | 11/2004 | Hervio | F17C 1/02 137/259 |
| 2007/0125286 | A1 * | 6/2007 | Lothe | B63B 25/14 114/74 R |
| 2008/0164251 | A1 * | 7/2008 | Fawley | B65D 88/128 220/1.5 |
| 2010/0186426 | A1 | 7/2010 | Campbell | |
| 2012/0137955 | A1 | 7/2012 | Van Tassel | |
| 2014/0028037 | A1 | 1/2014 | Ness | |
| 2014/0217107 | A1 * | 8/2014 | Sloan | F17C 1/00 220/581 |
| 2018/0009511 | A1 * | 1/2018 | Kang | B63B 25/04 |

FOREIGN PATENT DOCUMENTS

| | | | |
|---|---|---|---|
| EP | 2749807 | A1 | 7/2014 |
| NO | 20033149 | A | 1/2005 |
| RU | 2309321 | | 10/2007 |
| WO | 2009/137812 | A2 | 11/2009 |
| WO | 2011/018768 | A1 | 2/2011 |
| WO | 2012/074584 | | 6/2012 |
| WO | 2013/185135 | A1 | 12/2013 |

OTHER PUBLICATIONS

Written Opinion of the International Searching Authority issued in corresponding application No. PCT/EP2015/076297 dated Sep. 16, 2016 (8 pages).
Norwegian Search Report issued in corresponding application No. 20141365 dated Jun. 12, 2015 (2 pages).
English translation of RU office action of May 7, 2019, cited inter alia as statement of relevance for non-english citations.

* cited by examiner

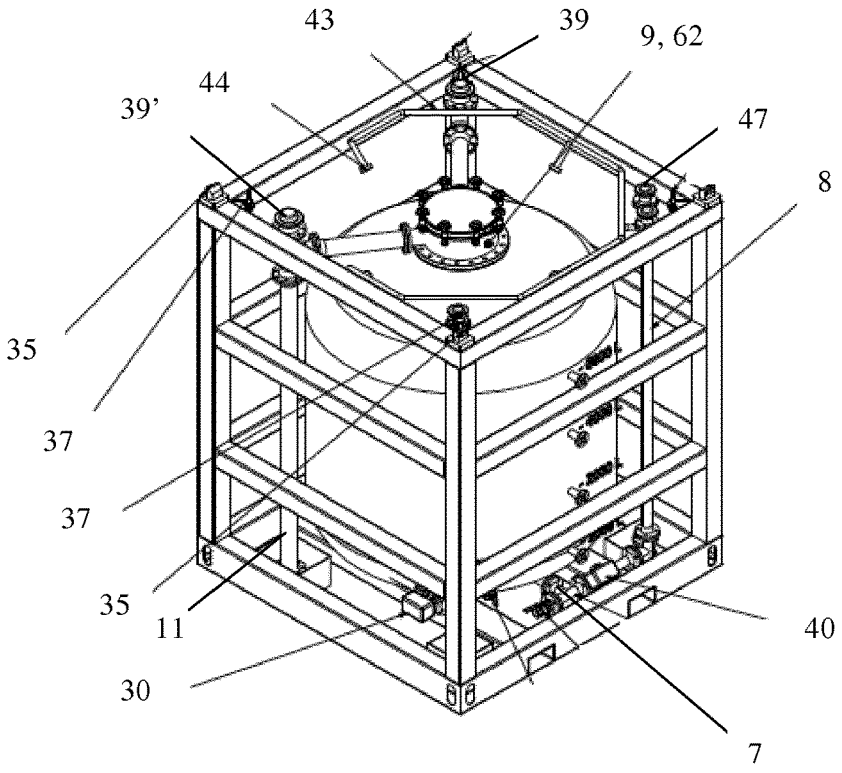
Fig. 1
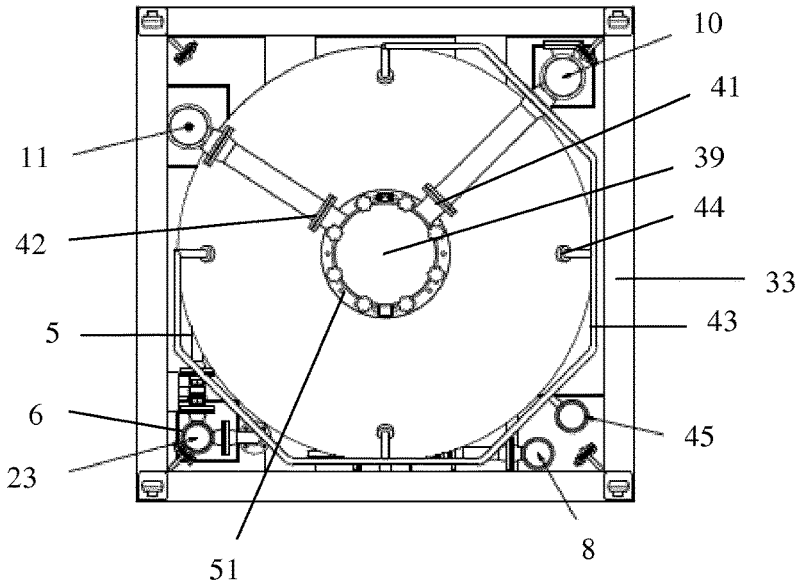
Fig. 2 (fig. 1 from above)

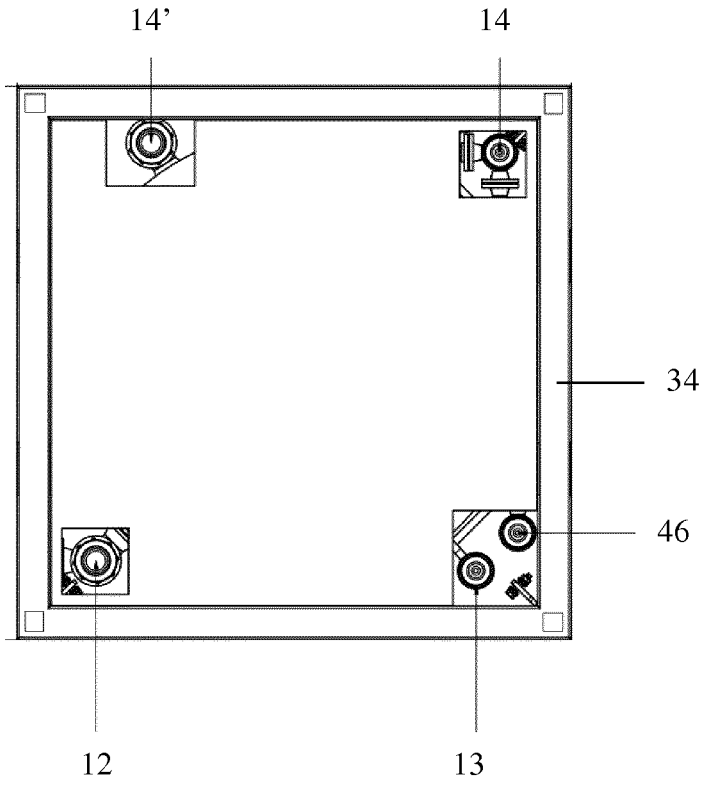
Fig. 3 (fig. 1 from below)

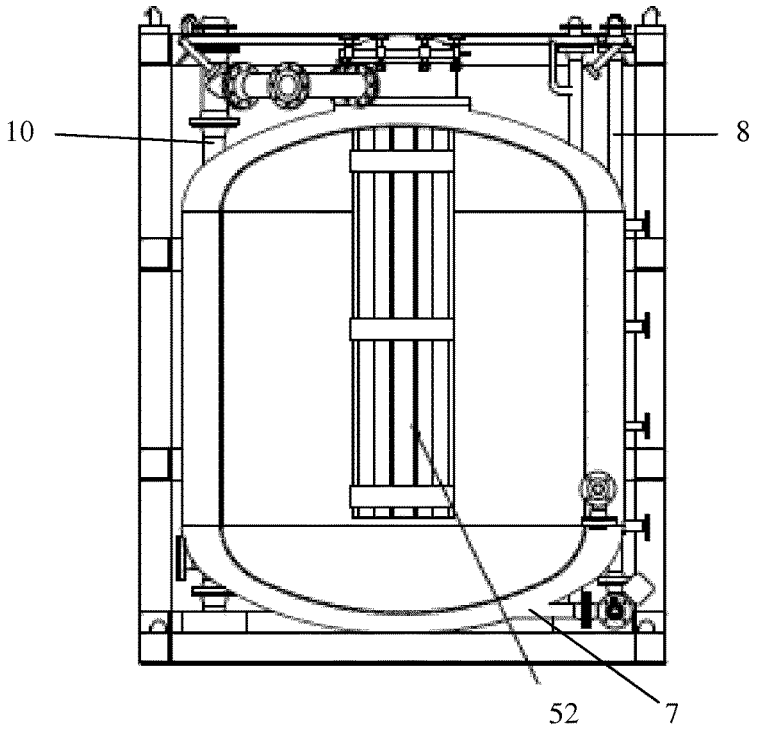
Fig. 6 (C-C)
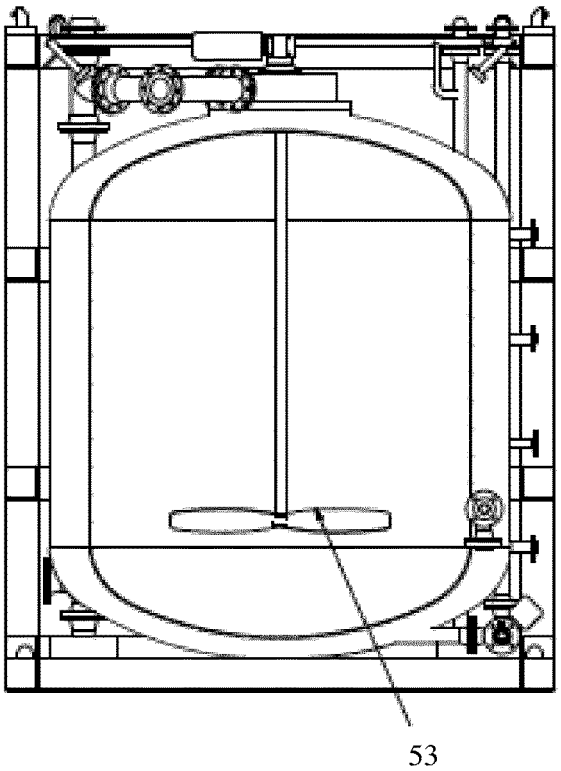
Fig. 7 (C-C)

TANK SYSTEM

FIELD OF THE INVENTION

One or more embodiments of the present invention relates to a modular tank system, as well as a tank and frame suitable for use in said system.

BACKGROUND

In off-shore oil industry, chemical tanks are commonly used for receiving, storage, back-loading, processing and transport of various fluids such as helifuel, Mono Ethylene Glycol (MEG), hydrocarbon contaminated drilling and completion fluids and crude/waste oil. Present tanks are provided as separate units arranged on various locations onboard an offshore installation. For example, on a semi-submersible drilling rig the location is typically the main deck, riser/pipe deck. Normally 2" rubber hoses are connected manually for transferring liquid to and from tanks, dependent upon operations.

Mounting and arranging prior art chemical tanks offshore is time consuming and also commonly requires welding of boundaries to obtain a drip/spill tray to capture any leakage from the tanks.

In for instance well test and completion operations the mounting/arranging is especially time consuming in connection with the installation of 30/50 $m^3$ storage tanks. Such installation does not only comprise welding and sea-fastening, including the boundaries mentioned above, but also the rig up of all rubber hoses for inlet and outlet, as well as for vent lines towards safe routing overboard, or to a flare system.

Due to limitations on rig structure, spreader beams are needed to be spotted and welded to strengthen the deck to distribute the heavy load from theses storage tanks mentioned above.

A further disadvantage of present 30/50 $m^3$ storage tanks is that they have to be shipped empty. Dimensions on some of the storage tanks are wider (width and height) than allowable for transport onshore with transport trucks. With a frame being wider than 2.6 m, a follow car is needed and transport is only allowed at certain time periods and weekdays.

Further, the 30/50 $m^3$ storage tanks are only for atmospheric pressure, and may not be used for liquids having concentrations of hydrocarbon gases entrapped.

For transportation, liquids from the 30/50 $m^3$ storage tanks must be transferred to portable slop tanks. Common sizes for portable tanks on the marked are 500 gallons and 1000 gallons (i.e. commonly from 2300 liters up to max 4500 liters), and they come in both vertical and horizontal configurations.

These portable tanks have only atmospheric pressure rating, and needs to be manned during filling operations. The filling occurs through an open manhole at the top of the tank. Consequently, personnel are exposed to fumes from hydrocarbon contaminated waste during filling. Further, the portable tanks are open vented under filling, and explosive fumes are a potential hazard onboard. The mix of both vertical and horizontal portable tanks shipped offshore, in combination with the deck layout (I-beams), makes it difficult to spot tanks next to each other for efficient space exploitation onboard a rig, where normally there is very little space available.

In addition to the above-described issues related to present storage tanks and/or portable slop tanks, some rigs also have limitations regarding the filling of portable slop tanks in that transfer and filling is only allowed after a well is shut in.

Further issues related to the present storage and/or portable slop tanks is that it is time consuming to transfer and fill the portable slop tanks during for instance a production testing, and further that none of the tanks have any integrated protection against fire. In present solutions, water must be rigged up/directed if not present onboard.

One or more embodiments of the present invention may avoid or alleviate at least some of the disadvantages of the prior art tanks and/or tank systems.

SUMMARY

One or more embodiments of the present invention provide a modular tank system, as well as a tank and amounting frame for use in such a system. The invention is defined in the appended claims and in the following:

In a first aspect, one or more embodiments of the present invention provide a modular tank system comprising at least two pressure tanks and a mounting frame, wherein

- each of the pressure tanks comprises a pressure vessel and a protection frame within which the pressure vessel is arranged, the protection frame is adapted, or arranged, such that multiple pressure tanks may be mounted on top of each other and the pressure vessel comprises a vent outlet and a first inlet, wherein
  - the vent outlet is arranged in an upper half of the pressure vessel, the first inlet is arranged in a lower half of the pressure vessel and is fluidly connected to a tank process line, the tank process line comprises a first fluid connector and a second fluid connector on opposite ends of the tank process line, such that the second fluid connector of a first pressure tank (i.e. one of the at least two pressure tanks) is connectable to the first fluid connector of a second pressure tank (i.e. another one of the at least two pressure tanks), when the second pressure tank is mounted on top of the first pressure tank; and
- the mounting frame comprises a base frame upon which the at least two pressure tanks may be mounted, the base frame comprises a frame process line; and the frame process line comprises at least two fluid connectors, each fluid connector connectable to the first fluid connector of a tank process line (i.e. connectable to the first fluid connector of one of the at least two pressure tanks) and arranged such that the frame process line may be, or becomes, fluidly connected to the tank process lines of the at least two pressure tanks when the pressure tanks are mounted upon the base frame side by side.

The first inlet of the pressure vessel is preferably arranged in a lower half of the pressure vessel, even more preferred arranged in a bottom part of the pressure vessel, such that the pressure vessel may be emptied through the inlet if required.

In the first aspect, one or more embodiments of the invention provide a modular tank system, wherein:

- the pressure vessel comprises a first outlet arranged in a lower half of the pressure vessel and fluidly connected to a tank suction line, the tank suction line comprising a first fluid connector; and
- the base frame comprises a frame suction line comprising at least two fluid connectors, each fluid connector connectable to the first fluid connector of the tank suction line (i.e. connectable to at least one of the first fluid connectors of the tank suction lines of the at least two pressure tanks) and arranged such that the frame suction line may be fluidly connected to the tank suction lines of the at least two pressure tanks when the pressure tanks are mounted upon the base frame side by side or on top of each other.

In the first aspect, one or more embodiments of the invention provide a modular tank system, wherein:

the vent outlet of the pressure vessel is a second outlet arranged in an upper half of the pressure vessel (such that gas may escape the pressure vessel when required) and fluidly connected to at least one of a tank vent line and a tank relief line, the tank vent line and/or the tank relief line comprises a first fluid connector; and the base frame comprises at least one of a frame vent line and a frame relief line, the frame vent line and/or the frame relief line comprises at least two fluid connectors, each fluid connector connectable to at least one of the first fluid connector of the tank vent line and the tank relief line (i.e. connectable to at least one of the first fluid connectors of the tank vent lines or tank relief lines of one of the at least two pressure tanks), and arranged such that at least one of the frame vent line and the frame relief line may be fluidly connected to the tank vent line and tank relief line of the at least two pressure tanks (or of one of the at least two pressure tanks), respectively, when the pressure tanks are mounted upon the base frame side by side or on top of each other.

In the first aspect, one or more embodiments of the invention provide a modular tank system, wherein the at least two fluid connectors of the frame process line, and the first fluid connector of the tank process line of the at least two pressure tanks, are arranged such that the frame process line is fluidly connected to the tank process line of one of the at least two pressure tanks when the pressure tank is mounted upon the base frame.

In the first aspect, one or more embodiments of the invention provide a modular tank system, wherein the frame process line, and optionally the frame suction line, the frame vent line and the frame relief line, comprises a process line port, a suction line port, a vent line port and a relief line port, respectively. Each of the respective line ports providing a common fluid connection to the at least two fluid connectors of the frame process line, the frame suction line, the frame vent line and the frame relief line, respectively.

In a second aspect, one or more embodiments of the present invention provide a pressure tank for use in a modular tank system according to the first aspect, the pressure tank comprises a pressure vessel and a protection frame within which the pressure vessel is arranged, the pressure vessel comprises a vent outlet and a first inlet, wherein the vent outlet is arranged in an upper half of the pressure vessel, preferably the top of the pressure vessel, and the first inlet is arranged in a lower half of the pressure vessel and fluidly connected to a tank process line, the tank process line comprising a first fluid connector and a second fluid connector arranged on opposite ends of the tank process line.

In the second aspect, one or more embodiments of the invention provide a pressure tank wherein the pressure vessel comprises a first outlet (7) arranged in a lower half of the pressure vessel, preferably in the bottom of the pressure vessel, and fluidly connected to a tank suction line (8), the tank suction line comprising a first fluid connector (13). The first outlet is preferably arranged at a level below the level of the first inlet.

In the second aspect, one or more embodiments of the invention provide a pressure tank wherein the vent outlet of the pressure vessel is a second outlet arranged in an upper half of the pressure vessel and fluidly connected to at least one of a tank vent line and a tank relief line, the tank vent line and the tank relief line comprises a first fluid connector.

In the second aspect, one or more embodiments of the invention provide a pressure tank, wherein the tank process line is arranged such that the first fluid connector of the tank process line is arranged at a bottom section of the pressure tank and the second fluid connector of the tank process line is arranged at a top section of the pressure tank.

In the second aspect, one or more embodiments of the invention provide a pressure tank wherein the first fluid connector and the second fluid connector of the tank process line are arranged such that said second fluid connector is connectable to a first fluid connector of the tank process line of another pressure tank according to the second aspect, when said another pressure tank is mounted on top of the pressure tank.

In the second aspect, one or more embodiments of the invention provide a pressure tank wherein the pressure vessel has a substantially circular circumference in a horizontal plane during use, and the inlet is arranged such that a process stream will enter the pressure vessel in a direction being substantially tangential to the circular circumference at the inlet.

In the second aspect, one or more embodiments of the invention provide a pressure tank comprising a tank process line and at least one of a tank suction line, a tank vent line or a tank relief line. Preferably, each of the tank process line, the tank suction line, the tank vent line and the tank relief line is arranged between the pressure vessel and the protection frame, such that the lines are not easily damaged. Further, each of the tank process line, the tank suction line, the tank vent line and the tank relief line comprises a pipe or conduit arranged in a substantially vertical direction when the pressure tank is in use.The pipe (or the tank process line, the tank suction line, the tank vent line or the tank relief line) comprises a first fluid connector and a second fluid connector, arranged at opposite ends of the pipe, wherein the first fluid connector is arranged at the bottom of the pressure tank and the second fluid connector is arranged at the top of the pressure tank.

In a third aspect, one or more embodiments of the present invention provide a mounting frame for use in a modular tank system according to the first aspect, comprising a base frame upon which at least two pressure tanks may be mounted, the base frame comprises a frame process line having at least two fluid connectors and at least one process line port, wherein each fluid connector is connectable to a first fluid connector of a tank process line of one of the at least two pressure tanks, and arranged such that the frame process line may be fluidly connected to the tank process line when said pressure tank is mounted upon the base frame.

In the third aspect, one or more embodiments of the invention provide a mounting frame wherein the base frame comprises a frame suction line comprising at least two fluid connectors and a suction line port, each fluid connector connectable to a first fluid connector of a tank suction line of one of the at least two pressure tanks and arranged such that the frame suction line may be fluidly connected to the tank suction line when the pressure tank is mounted upon the base frame.

In the third aspect, one or more embodiments of the invention provide a mounting frame wherein the base frame comprises at least one of a frame vent line and a frame relief line, the frame vent line and frame relief line comprising at least two fluid connectors and a relief line port and a vent line port, respectively, each fluid connector connectable to at least one of a first fluid connector of a tank vent line and a tank relief line of one of the at least two pressure tanks, and arranged such that at least one of the frame vent line and the frame relief line may be fluidly connected to the cooperating tank vent line and tank relief line when the pressure tank is mounted upon the base frame.

In the third aspect, one or more embodiments of the invention provide a mounting frame wherein the base frame comprises a first and second pair of parallel sidewalls, and a bottom plate.

In the third aspect, one or more embodiments of the invention provide a mounting frame wherein the sidewalls and bottom plate provides a drip tray into which spillage from a mounted pressure tank may be collected during use.

In the third aspect, one or more embodiments of the invention provide a mounting frame comprising two base frames pivotally connected, such that the base frames may be folded together.

The pressure vessel is preferably rated for pressures of at least 50 psi, in the range of 50-350 psi, or in the range of 150-250 psi. In the present disclosure, the term "pressure vessel" is intended to mean a vessel suitable for handling fluids under pressure, wherein at least parts of the fluids are liquids under normal atmospheric pressure and room temperature. The latter requirement introduces certain restrictions, especially regarding the level at which inlets and outlets must be arranged on the vessel to allow for inlet/outlet of liquids.

The term "is arranged in" in relation to the position of inlets/outlets of the pressure vessel is intended to define at which point a fluid passing through an inlet/outlet enters or exits the internal volume of the pressure vessel. For instance, a process fluid stream entering through the first inlet may optionally pass through the wall of the vessel at any suitable point, for example via a conduit, as long as the first inlet is arranged such that the process fluid enters the lower half of the pressure vessels internal volume. Preferably, the inlets/outlets pass through the wall of the pressure vessel at the position at which they are arranged.

SHORT DESCRIPTION OF THE DRAWINGS

The invention is described in more detail by reference to the following drawings of a preferred embodiment of a tank system comprising a pressure tank and a mounting frame:

FIG. 1 is a perspective view from above of a pressure tank for a tank system according to the invention.

FIG. 2 is a top view of the pressure tank in FIG. 1.

FIG. 3 is a perspective view from below of the pressure tank in FIG. 1.

FIG. 6 is a cross-sectional view of the pressure tank in FIG. 1. (filter for completion fluid treatment—brine filtration)

FIG. 7 is a cross-sectional view of a pressure tank similar to the one displayed in FIGS. 1-6. (agitator for mixing of fluids)

DETAILED DESCRIPTION OF AN EMBODIMENT OF THE INVENTION

Figure 4:
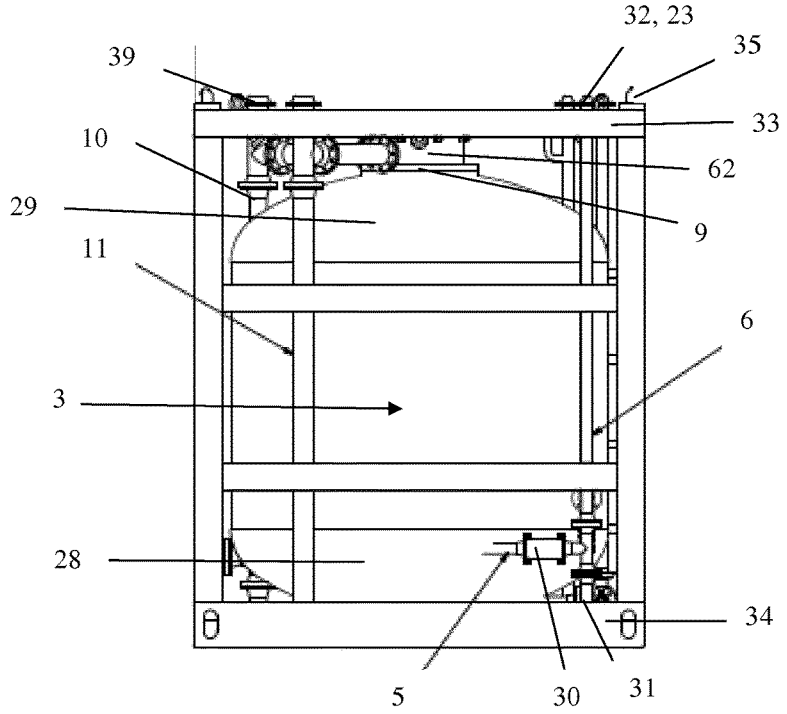
FIG. 4 is a first side view of the pressure tank in FIG. 1.

An embodiment of a pressure tank 1 for use in a modular tank system according to the invention is depicted in FIG. 1-7. The pressure tank 1 comprises a pressure vessel 3 arranged within a protection frame 4. The pressure vessel 3 is formed as a cylinder with hemispherical or torispherical end caps 28,29. In use, the pressure vessel 3 is oriented such that the centerline of the cylinder is arranged in a vertical direction. The end caps form a lower end cap 28 (or bottom part) and an upper end cap 29 (or top part). The pressure vessel 3 has an inlet 5 at the lower end cap 28. The inlet 5 is primarily for allowing fluids to enter the pressure vessel 3. Due to its location at the lower half of the pressure vessel, the inlet 5 may in other embodiments of the invention also be used for withdrawing fluids from said vessel. A horizontal cross-section (or the circumference in a horizontal plane) of the pressure vessel is substantially circular over the whole height of the pressure vessel. The inlet 5 is arranged such that a fluid stream entering the pressure vessel via the inlet will have a direction being substantially tangential to the circumference at the inlets point of entry into said vessel 3. The inlet 5 is fluidly connected to a tank process line 6. A pneumatic actuator driven valve 30 is arranged between the inlet 5 and the tank process line 6. The tank process line 6 has a first end 31 and a second end 32 and extends in a direction from the lower end cap 28 to the upper end cap 29. The tank process line 6 is equipped with a fluid connector at each of its two ends. The first fluid connector 12 is arranged at the first end 31 of the tank process line 6 and the second fluid connector 23 is arranged at the second end 32.

In order to fluidly connect the tank process line 6 of a first pressure tank with the tank process line of a second pressure tank 1', the first fluid connector 12 and the second fluid connector 23 of the tank process line are arranged such that the second fluid connector 23 of the first pressure tank 1 will connect with the first fluid connector of the second pressure tank 1' when said second pressure tank 1' is mounted on top of the first pressure tank 1, see also FIGS. 15-18. In this embodiment this is achieved by having an end of the second fluid connector 23 extending slightly above the upper cross beams 33 of the protection frame 4 and having an end of the first fluid connector 12 substantially in line or slightly above the lower cross beams 34 of the protection frame 4, see FIG.

3. Preferably, both the first fluid connector and the second fluid connector are cooperating halves of a clean break coupling featuring a double valve arrangement. When coupled, the double valve arrangement is fully open allowing passage of fluid. When disconnected, the valve arrangement of both the first and second fluid connector is closed. This feature ensures that leakage is avoided during coupling or disconnection. Such connectors are well known to the skilled person. When not coupled, the first and second fluid connector 12, 23 (in addition to the actuator operated ball valve 30) will also act as a second fluid barrier during for instance transportation.

Figure 8:
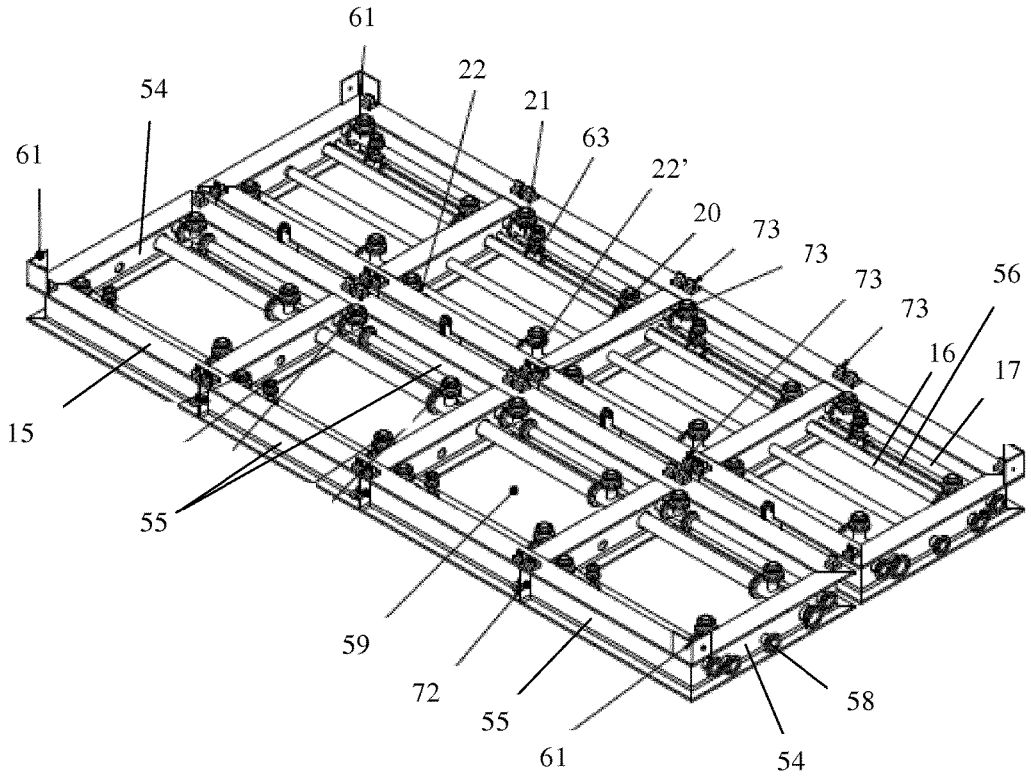
FIG. 8 is a perspective view of a mounting frame for a tank system according to the invention.
Figure 9:
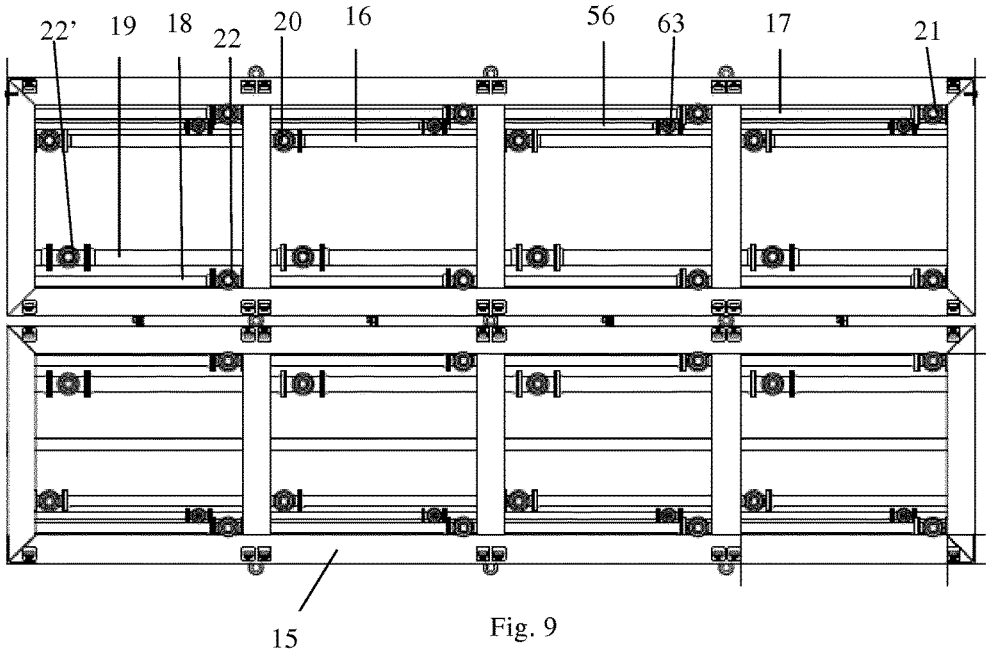
FIG. 9 is a top view of the mounting frame in FIG. 8.
Figure 10:
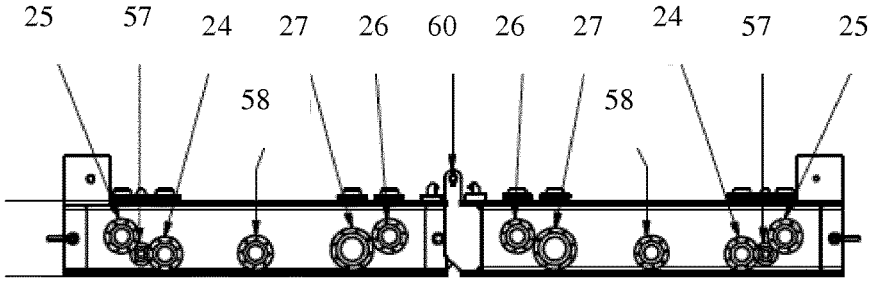
FIG. 10 is a side view of the mounting frame in FIG. 8.
Figure 11:
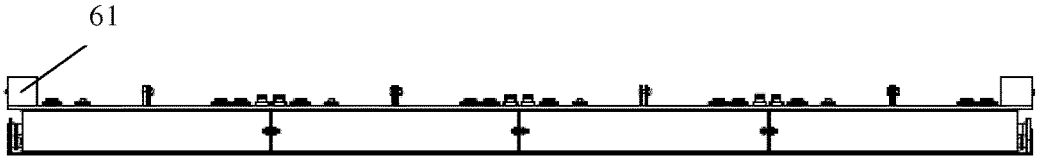
FIG. 11 is a side view of the mounting frame in FIG. 8.

The first and second pressure tank are secured together by having the upper face of the upper cross beams featuring first locking means 35, for instance a pneumatic twist lock, and the lower face of the lower cross beams featuring second locking means, for instance a recess, e.g. an ISO corner, for receiving the first locking means when the second pressure tank is mounted on top of the first pressure tank. Cooperating locking means 73, preferably similar to the first locking means 35, are also arranged on the mounting frame, see FIG. 8, for locking the pressure tanks to the frame.

To facilitate transport and movement of the pressure tank, the protection frame comprises lifting eyes 37 secured to the upper cross beams.

Further, the pressure vessel 3 of the present pressure tank comprises a suction outlet 7 (or a first outlet 7), and a vent/relief outlet 9 (or a second outlet 9).

The suction outlet 7 is for withdrawing fluids from the pressure vessel 3, and is arranged at the lower end cap 28 of the pressure vessel. The suction outlet 7 is fluidly connected to a tank suction line 8. A pneumatic actuator driven valve 40 is arranged between the suction outlet 7 and the tank suction line 8. The valve 40 acts as a first fluid barrier. The tank suction line is arranged similar to the tank process line 6, featuring a first fluid connector 13 and a second fluid connector 38, at the lower cross beam 34 and the upper cross beam 33, respectively. The second fluid connector 38 of the tank suction line 8 of a first pressure tank 1 is able to connect with the first fluid connector 13 of the tank suction line 8 of a second pressure tank 1' in a manner as described above for the tank process line. When not coupled, the first and second fluid connector 13, 38 of the tank suction line 8 will act as a second fluid barrier during for instance transportation.

The vent/relief outlet 9 is fluidly connected to a tank vent line 10 and a tank relief line 11 through a distributor 62 having a distributor vent line outlet 41 and a distributor relief line outlet 42. The tank vent line 10 and the tank relief line 11 are arranged similar to the tank process line 6, both the tank vent line and the tank relief line featuring a first fluid connector 14,14' and a second fluid connector 39,39', at the lower cross beam 34 and the upper cross beam 33, respectively. The second fluid connectors 39,39' of the tank vent line 10 and the tank relief line 11 of a first pressure tank 1 are able to connect with the first fluid connectors 14,14' of the tank vent line 10 and the tank relief line 11, respectively, of a second pressure tank 1' in a manner as described above for the tank process line. The pressure vessel 3 may be depressurized via the distributor by allowing gas to be routed through the vent line 10 to a safe zone. The distributor relief line outlet 42/tank relief line 11 act as the last barrier to avoid rupture of the pressure vessel. Pressure build-up in the tank relief line 11 above maximum allowable work pressure will initiate opening of a rupture disc or safety valve.

The pressure tank 1 also features a fire extinguishing system comprising a deluge pipe section 43 featuring a suitable number of spray nozzles 44. The pipe section is arranged on the upper cross beams 33 of the protective frame and the spray nozzles are arranged to direct a spray of for instance water towards the pressure vessel 3. The deluge pipe section 43 is fluidly connected to a tank deluge line 45. The tank deluge line 45 is arranged similar to the tank process line 6, the tank deluge line 45 featuring a first fluid connector 46 and a second fluid connector 47, at the lower cross beam and the upper cross beam, respectively. The second fluid connector 47 of the tank deluge line 45 of a first pressure tank 1 is able to connect with the first fluid connector 46 the tank deluge line 45 of a second pressure tank 1' in a manner as described above for the tank process line, and/or to a fluid connector on a frame deluge line, as described below.

Figure 5:
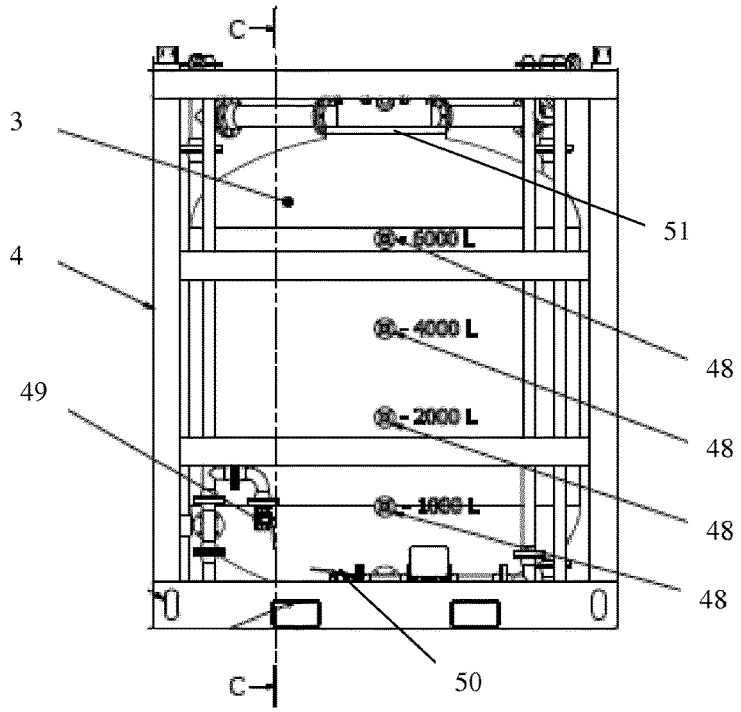
FIG. 5 is a second side view of the pressure tank in FIG. 1.

Flanges 48 are arranged on the pressure vessel for accommodating level and/or pressure measuring sensors, see FIG. 5.

The tank process line and/or the inlet 5 is fluidly connected to a manual ball valve 49, and the tank suction line and/or suction outlet 7 is fluidly connected to a manual ball valve 50. The ball valves 49,50 provide the possibility of manually emptying the tank if needed and also use of the tank independent of the mounting frame described below.

The pressure vessel 3 may be manufactured in any suitable material. Commonly, pressure vessels are made in stainless steel, but the pressure vessel may advantageously also be made in a transparent material having the required properties, such as carbon fiber, an acrylic polymer, polymer composites comprising reinforcing glass fiber, combinations thereof and similar.

The pressure vessel features a large flange 51, for instance 20 inch, arranged in the upper end cap 29. The large flange enables the option of having the pressure vessel equipped with a filter unit 52 for completion fluid treatment such as brine filtration, or with an agitator 53 for mixing of fluids. An embodiment of a pressure tank featuring a filter unit 52 is shown in FIG. 6 and a pressure vessel featuring an agitator 53 is shown in FIG. 7.

An embodiment of a mounting frame 2 for use in a modular tank system according to the invention is depicted in FIGS. 8-14. The mounting frame comprises two base frames 15. Each base frame 15 comprises profiled beams forming a substantially rectangular frame having a first 54 and second 55 pair of parallel sidewalls. A bottom plate 59 is attached to the rectangular frame and provides a drip tray into which spillage from a mounted pressure tank 1 may be collected. A spillage port 58 is arranged through one of the side walls 54 for emptying the drip tray. A guide bracket 61 is arranged at each corner of the mounting frame 2 for guiding and holding a mounted pressure tank 2 in a correct position prior to locking. A frame process line 16, a frame suction line 17, a frame vent line 18, a frame relief line 19 and a frame deluge line 56 are arranged within the base frame. Each of the lines extend between the first pair of parallel side walls 54, and features a frame port (for inlet/outlet of fluids) on both outside faces of said first pair of side walls. The frame process line 16 comprises a frame process line port 24, the frame suction line 17 comprises a frame suction line port 25, the frame vent line 18 comprises a frame vent line port 26, the frame relief line 19 comprises a frame relief port 27, and the frame deluge line 56 comprises a frame deluge line port 57, see FIG. 10. The ports may be fluidly connected to any suitable external equipment. Such equipment may for instance be a calibration tank, or fluid pump, connected to the frame process line port 24, a rig fire water system to the frame deluge line port 57, etc.

Further, the frame process line 16 comprises multiple fluid connectors 20, the fluid connectors are each connectable to a first fluid connector 12 of the tank process line 6 of a pressure tank 1, when said pressure tank is mounted on the base frame 15 (or mounting frame 2). Similarly, the frame suction line 17 comprises multiple fluid connectors 21, the fluid connectors are each connectable to a first fluid connector 12 of the tank suction line 8 of a pressure tank 1, when said pressure tank is mounted on the base frame 15 (or mounting frame 2); the frame vent line 18 comprises multiple fluid connectors 22, the fluid connectors are each connectable to a first fluid connector 14 of the tank vent line 10 of a pressure tank 1, when said pressure tank is mounted on the base frame 15 (or mounting frame 2); the frame relief line 19 comprises multiple fluid connectors 22', the fluid connectors are each connectable to a first fluid connector 14' of the tank relief line 11 of a pressure tank 1, when said pressure tank is mounted on the base frame 15 (or mounting frame 2); and the frame deluge line 56 comprises multiple fluid connectors 63, the fluid connectors are each connectable to a first fluid connector 46 of the tank deluge line 45 of a pressure tank 1, when said pressure tank is mounted on the base frame 15 (or mounting frame 2).

Figure 12:
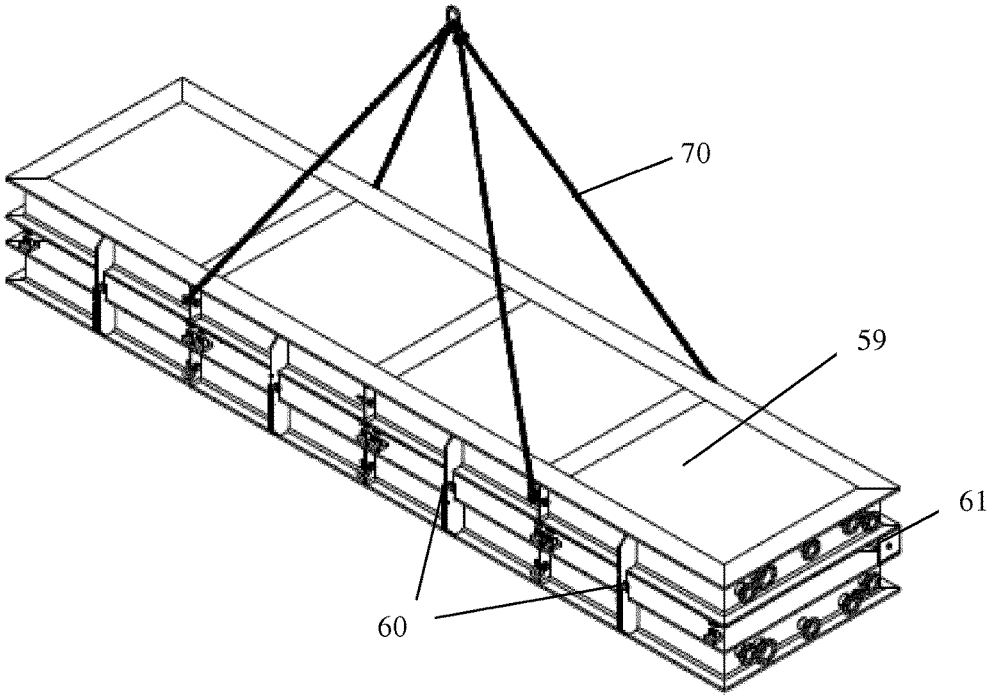
FIG. 12 is a perspective view of the mounting frame in FIG. 8 when said frame is folded.
Figure 13:
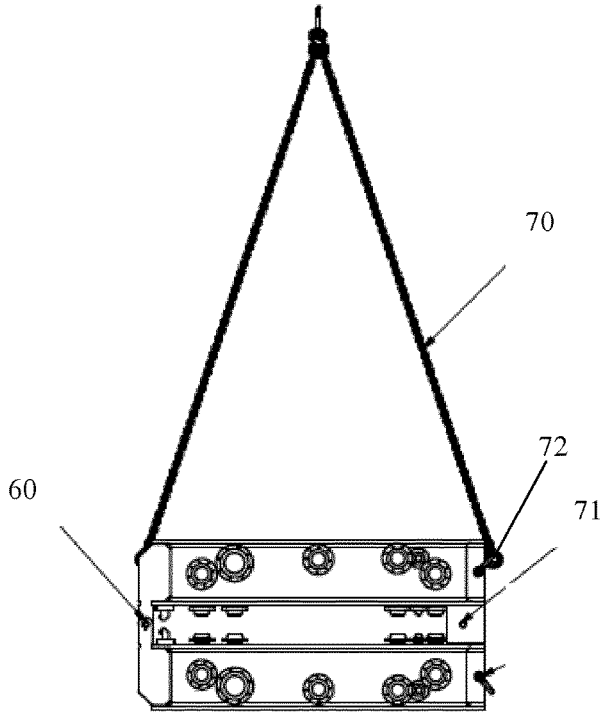
FIG. 13 is a first side view of the folded mounting frame in FIG. 12.
Figure 14:
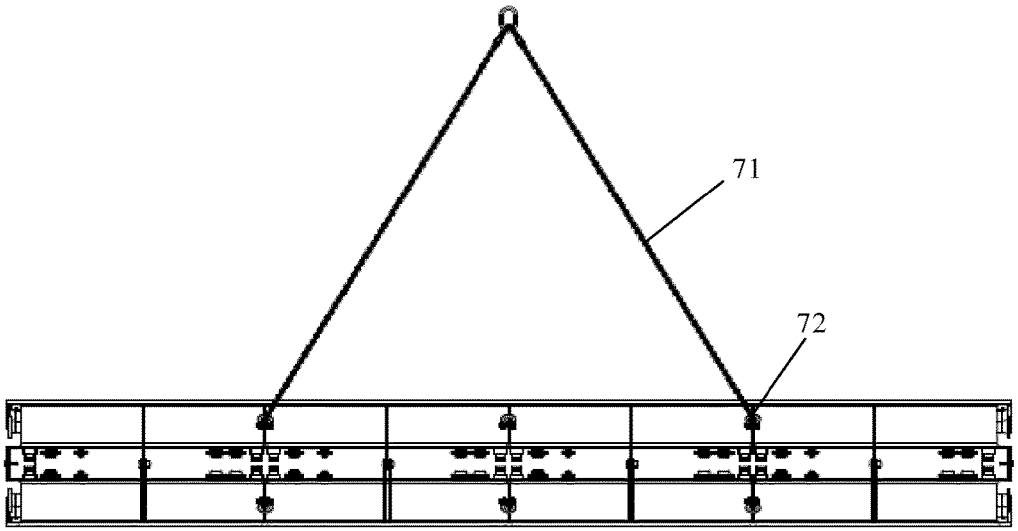
FIG. 14 is a second side view of the folded mounting frame in FIG. 12.
Figure 15:
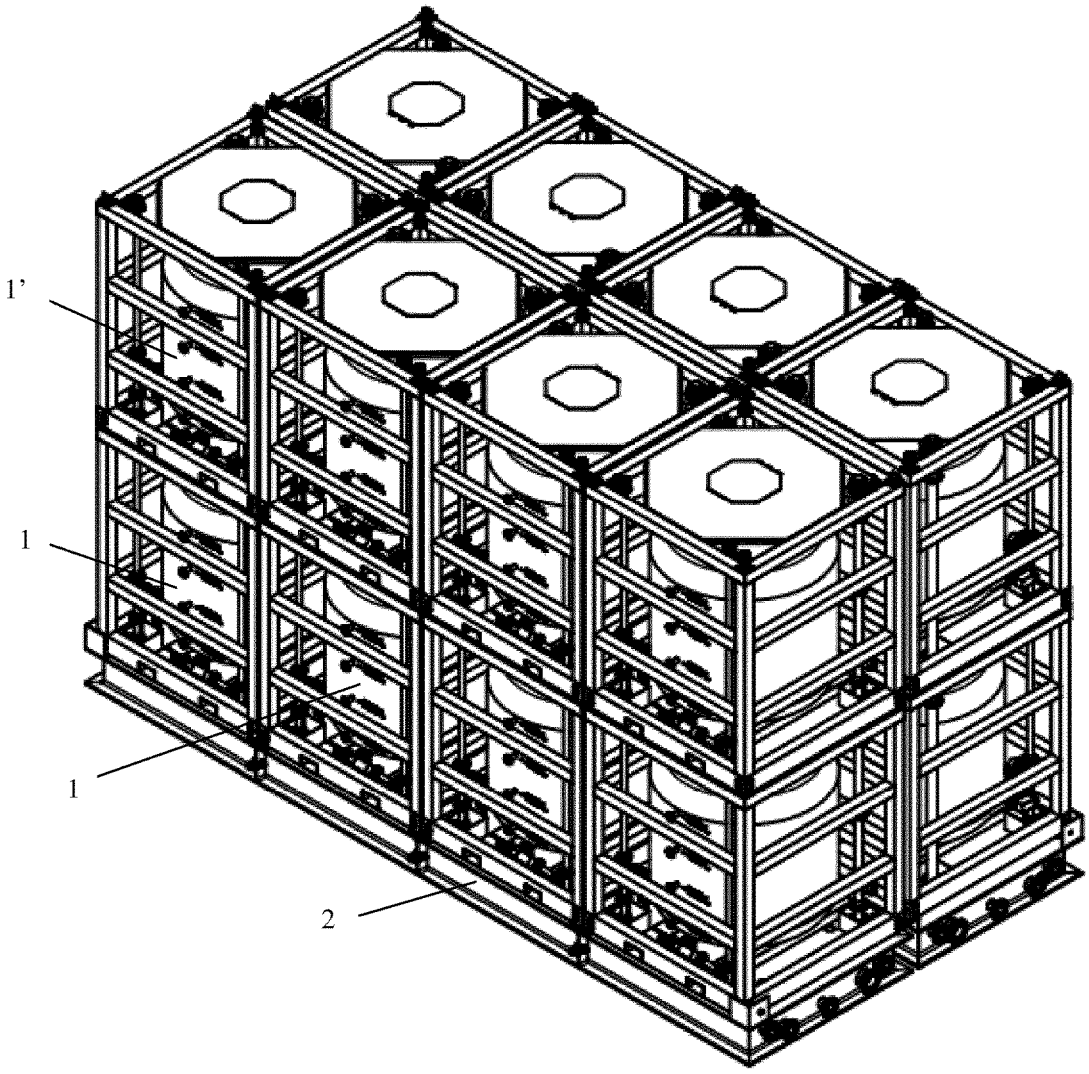
FIG. 15 is a perspective view of a tank system according to the invention.
Figure 16:
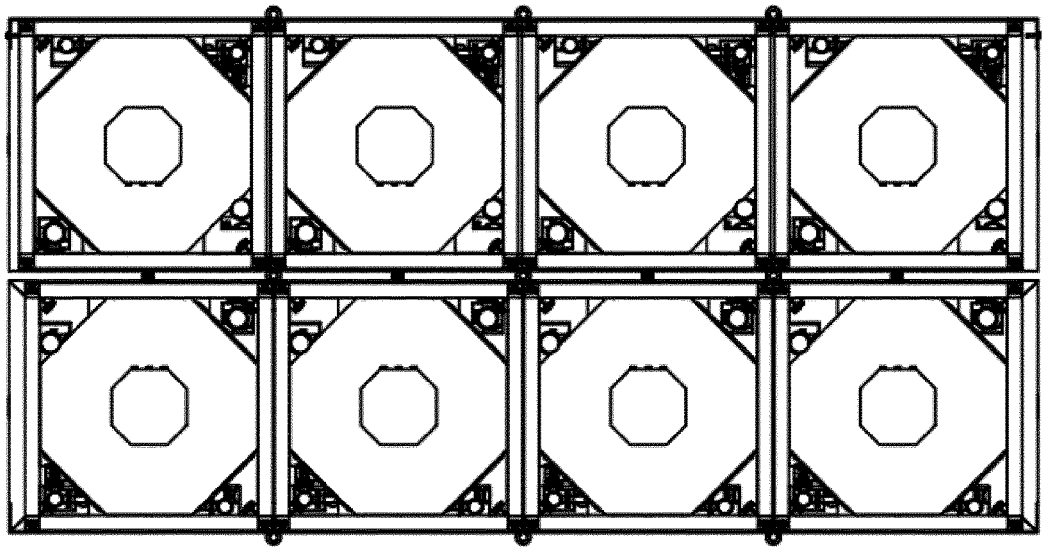
FIG. 16 is a top view of the tank system in FIG. 15.

The two base frames 15 are pivotally connected by hinges 60, see FIGS. 10-13. The hinges 60 are arranged along two adjacent side walls of the two base frames, and allows for folding one base frame on top of the other as shown in FIG. 12-14. When the two base frames are folded, the bottom plate 59 of one of the base frames 15 forms a top cover of the folded mounting frame. By this arrangement, i.e. the two base frames are folded to a box like structure, wherein the side walls 54,55 and bottom plates 59 constitute the external surfaces, the fluid connectors of the various frame lines are protected during transportation. The hinges 60 and the guide brackets 61 ensure a sufficient distance between the fluid connectors of the two base frames when folded, such that the fluid connectors are not in detrimental contact. The ability to fold the mounting frame is highly advantageous in that it provides a compact mounting frame which is easy to transport, and which at the same time lowers the risk of damage to vulnerable fluid connectors during said transportation. When folded, the two base frames are locked together by use of locking bolts 71, and the mounting frame may easily be transported by connecting a lift sling 70 to lifting eyes 72 arranged on the frame.

A modular tank system according to the invention is depicted in FIGS. 15-18. The system comprises a mounting frame 2 and 16 pressure tanks 1,1' mounted thereon. As shown, the pressure tanks may be stacked both on top of each other (1 and 1') and/or side by side (1 and 1). The frame and tanks are as described above.

Figure 17:
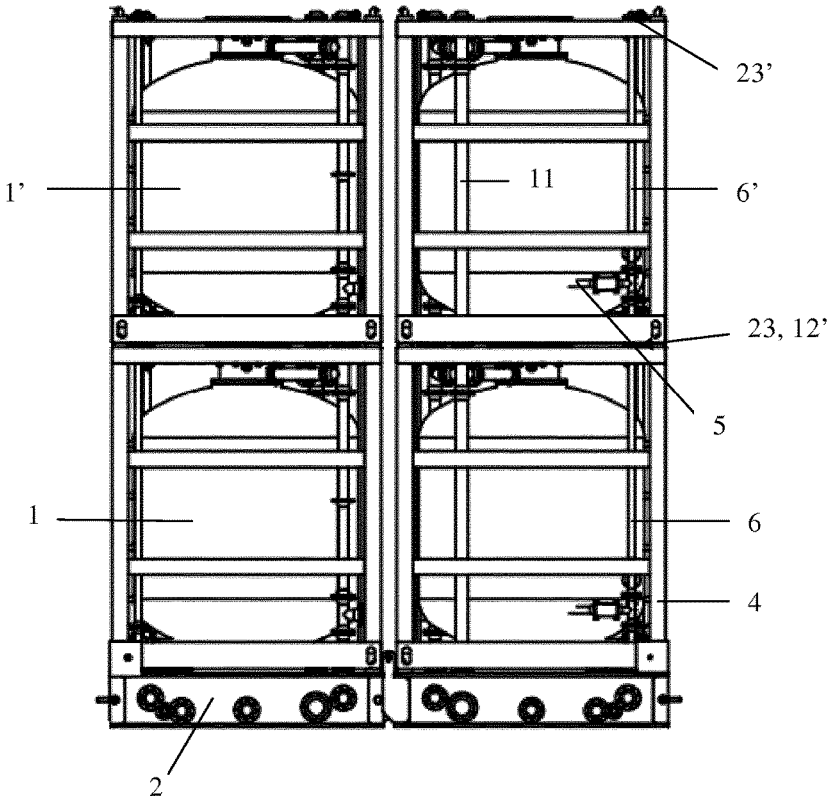
FIG. 17 is a side view of the tank system in FIG. 15.
Figure 18:
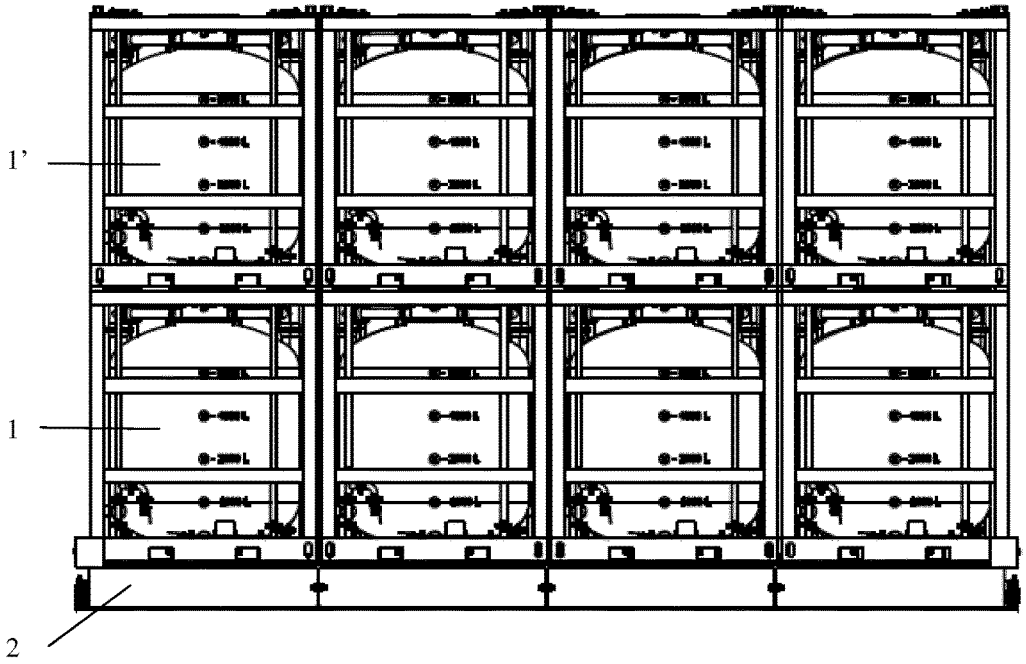
FIG. 18 is a side view of the tank system in FIG. 15.

The stacking of two pressure tanks 1,1' on top of each other is shown in more detail in FIG. 17. The tank process line 6' of the upper pressure tank 1' is in fluid communication with the tank process line 6 of the lower pressure tank 1 via a coupling 23,12' between the first fluid connector 12' of the upper pressure tank and the second fluid connector 23 of the tank process line 6 of the lower pressure tank 1. The coupling is not visible in FIG. 17, as it is hidden behind the cross beams of the protection frame 4. The tank process lines 6,6' are further fluidly connected to a frame process line 16 via the first fluid connector 12 of the tank process line 6 of the lower pressure tank 1. The first fluid connector 12 is coupled to a fluid connector 20 on the frame process line 16. The coupling 12,20 is not visible in FIG. 17, as it is hidden behind the lower cross beams of the protection frame 4.

The embodied modular tank system comprises several features making it highly suitable for extensive processing of a provided fluid. However, more simple embodiments will also be highly advantageous in providing a tank system for tasks such as oil spill recovery, which does not require any further processing apart from loading, storage and subsequent transportation. Other possible applications of the modular tank system is in storage of glycol offshore, well testing services, connected to cleaning process equipment during general platform and rig shutdown, other well service operations, such as snubbing and coil tubing operations involving degassing, treatment and circulation of completion fluids (brine) during milling, washing operations etc.

Detailed Description of Some Well Test Applications of the Modular Tank System According to the Present Invention Cleanup Flow:

Providing a cleanup flow is usually the last step before handing over a well to the production facilities. A semi submersible drilling rig is the typically workhorse that both drill and run completions to finalize a well.

An increased amount of production wells have long horizontal sections with one or more branches (multilateral). Consequently, this leads to an increased amount of drilling and completion fluids that must be removed in order to get the well flowing.

Figure 19:
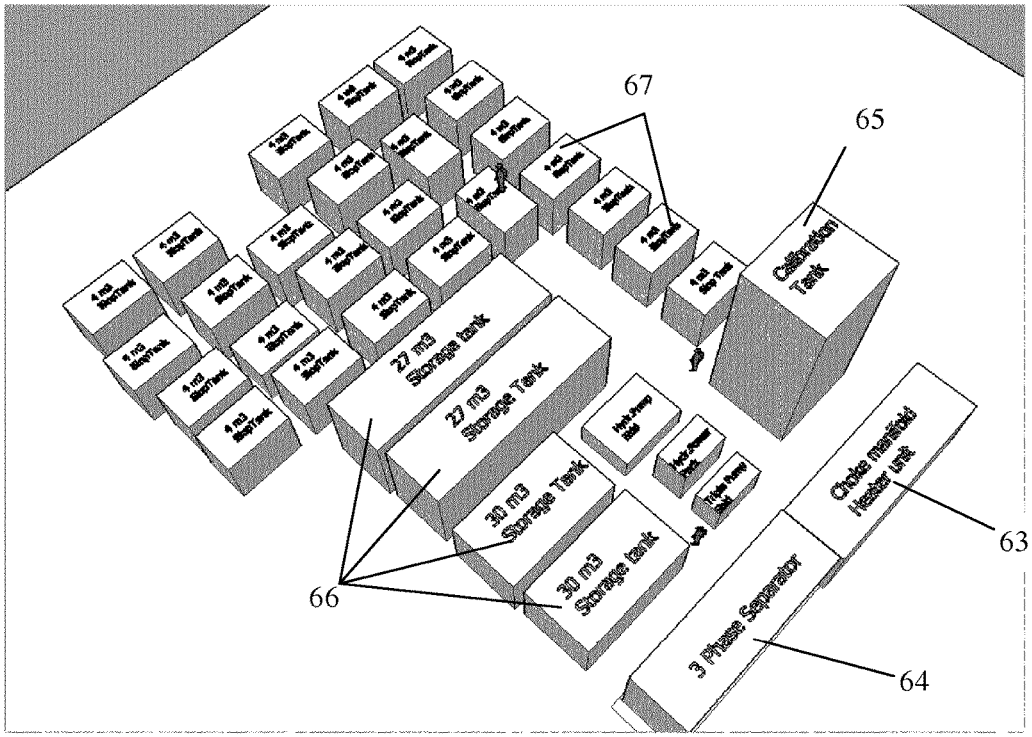
FIG. 19 is a schematic view of a prior art well test setup.

A well test plant is mobilized and connected to the well to provide a means for safely collecting drilling and completion fluids, as well as hydrocarbons, see FIG. 19.

The main equipment for distributing various liquids, and safely handle hydrocarbons, are:

- a choke manifold 63 (for adjusting and controlling the amount of flow from the well before entering pressurized vessels);
- 3 phase separator 64 (liquids and gases are separated, high pressure gas routed to flare); and
- a calibration tank 65 (for accumulating drilling and completion fluids, while simultaneously venting entrapped gas, as well as means of verifying the crude oil rate by diverting oil from the separator).

Production cleanup to well test facilities involves offloading the drilling and completion fluids to a storage facility onboard the rig, followed by transfer/shipping onshore to a dedicated disposal facility.

Various storage tanks 66 are commonly used to make sure there is a high storage capacity. Such tanks are supplied by various vendors, and have capacities ranging from 25 $m^3$ up to 50 $m^3$. A common feature of all these tanks is that they have a low pressure rating of max allowable work pressure of 1.5 bars. They have to be shipped empty. Operationally these tanks constitute a temporary step for gaining time before transferring the drilling and completion fluids into portable slop tanks.

Figure 20:
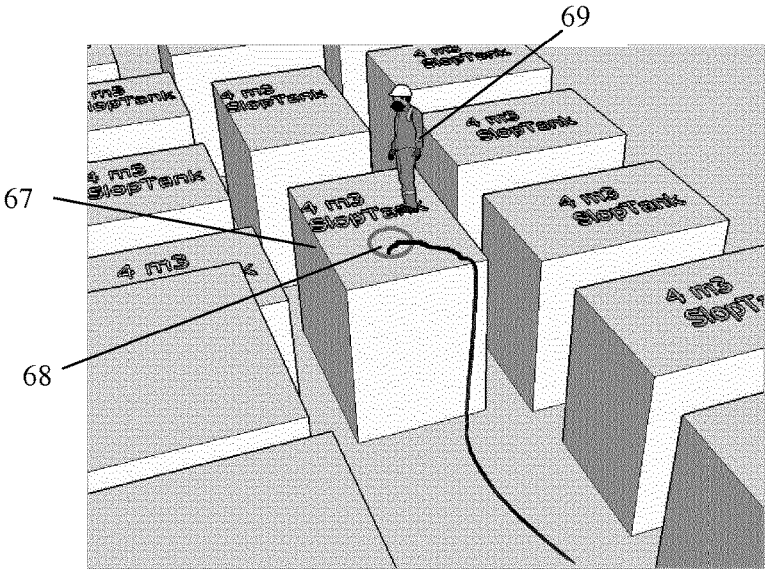
FIG. 20 is a schematic view of the setup of FIG. 19, wherein personnel is present at the top of a portable slop tank.

Portable slop tanks 67 are made in huge numbers from various vendors. Typically, these tanks are made in two sizes (2.3 $m^3$ and 4-4.5 $m^3$) and have atmospheric pressure rating. As a consequence, these tanks are only to be filled from the top (through an open manhole 68) by a person 69 operating a 2" hose. To have volume control (i.e. avoid overfill) it is necessary to have a person on top of the tank during filling at all times, see FIG. 20. The person must be equipped with a mask (to protect against gas fumes) and a fall arrestor.

These portable slop tanks 67 do not have any drip tray to collect spill, therefore the rig is responsible for making sure there is a closed system around the tanks to catch any accidental discharge/spillage.

In summary, the liquid flow path in a present system for cleanup flow is:

Test Separator⇒Calibration Tank⇒30/50 $m^3$ Tank⇒Portable Tanks⇒Lift to Supply vessel In this connection it is worth mentioning that the liquid transfer stage between the calibration tank and the portable tanks has a large impact on the rate of cleanup due to the capacity of the triple skid diaphragm transfer pump. To avoid overfilling of the calibration tank during the cleanup process, the well has to be held back on the choke to limit the flow to avoid overfilling and discharge to sea.

Directing the liquid flow directly to the 30 $m^3$ storage tank or the portable slop tanks (i.e. bypassing the calibration tank) is forbidden due to the high gas quantity in the drilling/completion fluids.

By using the modular tank system (MTS) according to the invention, the liquid flow path is significantly simplified:

Test separator⇒MTS⇒Lift to Supply vessel

Figure 21:
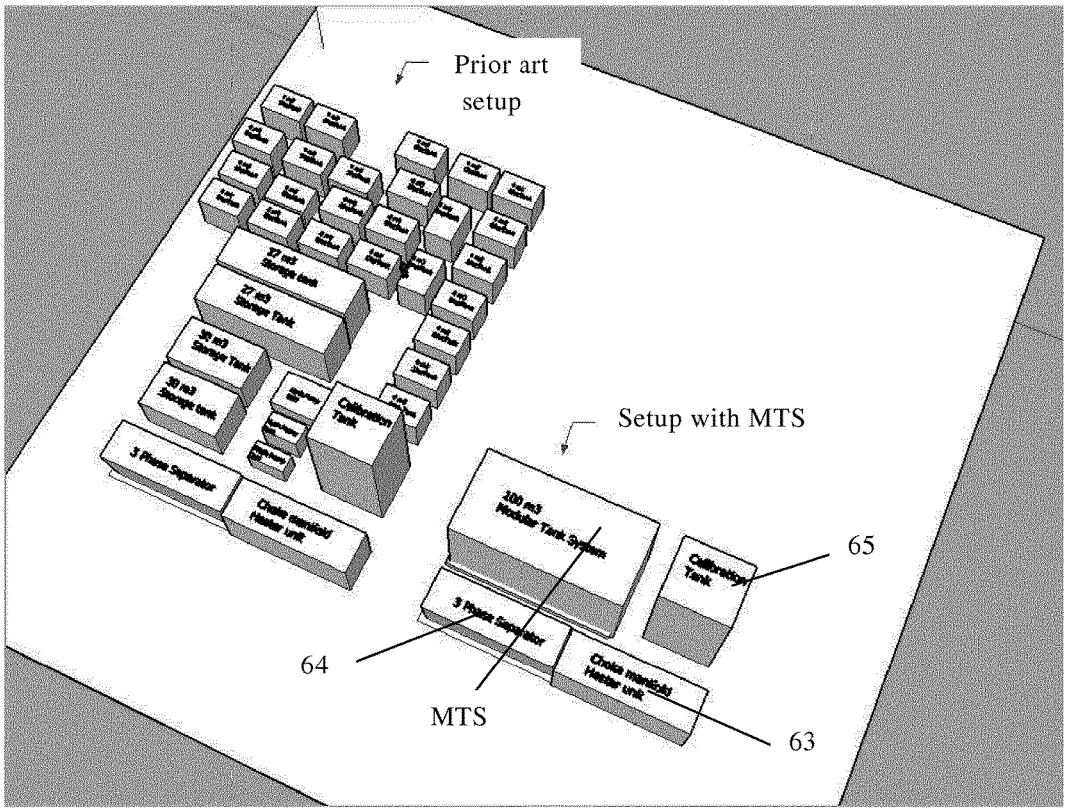
FIG. 21 is a schematic view of a prior art well test setup and a well test setup comprising a MTS according to the present invention.

The significantly lower space requirement of a cleanup flow system comprising the MTS according to the invention, compared to a common present day system, is illustrated in FIG. 21.

In short, the MTS allows for:

Higher cleanup rates=faster unloading of the cushion/removal of drilling and completion fluids=less environmental impact (reduced flaring operations).

Drill Stem Testing:

Drill stem testing is an oil and gas exploration procedure to isolate, stimulate and flow a downhole formation to determine the fluids present and the rate at which they can be produced.

The main objective of a DST is to evaluate the commercial viability and the economic potential of a zone by identifying production capacity, pressure, permeability or extent of an oil or gas reservoir. These tests can be performed in both open and cased hole environments and provide exploration teams with valuable information about the nature of the reservoir.

The test is an important measurement of pressure behavior at the drill stem and is a valuable way of obtaining information on the formation fluid and establishing whether a well has found a commercial hydrocarbon reservoir.

The extent of drilling fluids in return on these wells are minor, however since this is an exploration well, there are uncertainties regarding the amount of flow, pressures and quality of the crude oil when it comes to combustion and burning. The risk of pollution to the sea during these operations is higher than in production cleanups.

The Barents Sea is a typical place where the oil companies and rigs are more cautious and protective towards environmental impact.

The MTS can provide liquid capacity on the rig to perform long enough flow periods to gather/obtain necessary data without having to burn crude oil.

Figure 22:
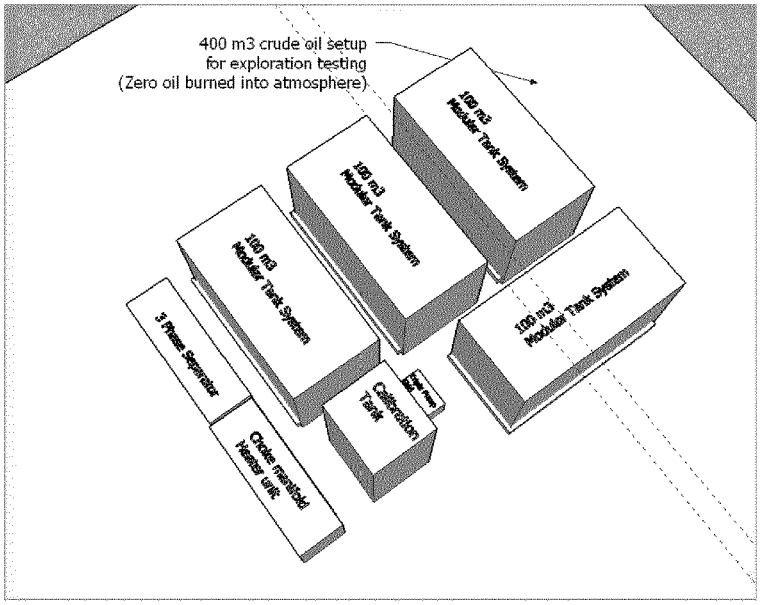
FIG. 22 is a schematic view of an exploration testing setup comprising a MTS according to the invention.

An example of a setup for exploration testing is illustrated in FIG. 22.

In conclusion, the present invention provides a modular tank system having a number of advantages in that it:

- removes the need for the current combination of 30-50 $m^3$ storage tanks and portable storage tanks (slop tanks).
- provides better utilization of deck space and increased storage capacity on surface to handle larger volumes of drilling fluids. Thus, increasing the chance of keeping the well flowing until free from drilling fluids.
- reduces the amount of load carriers.
- enhances the safety of, and reduces the hazards for, the personnel working directly with dynamic well operations, such as intervention and commissioning of production wells, well test clean-up and exploration testing.
- provides faster and more efficient unloading of the drilling and completion fluids during initial start up of a production well to avoid unwanted stop due to capacity issues and/or transfer limitations.
- reduces environmental impact due to more efficient clean-up operations.
- provides a means for collecting crude oil on exploration testing, such that environmental risk related to burning is minimized.
- reduces hotwork/seafastening and general rig-up time.
- provides rapid mobilization of a temporary storage system (depot) towards emergency response scenarios, such as oil spill on and offshore.
- treats completion fluids for reuse (degassing/removal of dissolved gases from completion fluids).

The invention claimed is:

1. A modular tank system comprising at least two pressure tanks and a mounting frame, wherein each of the pressure tanks comprises a pressure vessel, a tank process line and a protection frame within which the pressure vessel and the tank process line is arranged, the protection frame is adapted such that multiple pressure tanks may be mounted on top of each other and the pressure vessel comprises a vent outlet and a first inlet, wherein the vent outlet is arranged in an upper half of the pressure vessel, the first inlet is arranged in a lower half of the pressure vessel and is fluidly connected to the tank process line , the tank process line comprises a first fluid connector and a second fluid connector on opposite ends of the tank process line, and the tank process line is arranged such that the first fluid connector of the tank process line is arranged at a bottom section of the pressure tank and the second fluid connector of the tank process line is arranged at a top section of the pressure tank, such that the second fluid connector of a first pressure tank will connect to the first fluid connector of a second pressure tank, when the second pressure tank is mounted on top of the first pressure tank, the mounting frame comprises a base frame upon which the at least two pressure tanks may be mounted, the base frame comprises a frame process line;

the frame process line comprises at least two fluid connectors, each fluid connector connectable to the first fluid connector of a tank process line and arranged such that the frame process line may be fluidly connected to the tank process lines of the at least two pressure tanks when the pressure tanks are mounted upon the base frame side by side.

2. A modular tank system according to claim 1, wherein:

the pressure vessel comprises a first outlet arranged in a lower half of the pressure vessel and fluidly connected to a tank suction line, the tank suction line comprising a first fluid connector; and the base frame comprises a frame suction line comprising at least two fluid connectors, each fluid connector connectable to the first fluid connector of a tank suction line and arranged such that the frame suction line may be fluidly connected to the tank suction lines of the at least two pressure tanks when the pressure tanks are mounted upon the base frame side by side.

3. A modular tank system according to claim 1 or 2, wherein:

the vent outlet of the pressure vessel is a second outlet arranged in an upper half of the pressure vessel and fluidly connected to at least one of a tank vent line and a tank relief line , the tank vent line and the tank relief line comprises a first fluid connector; and the base frame comprises at least one of a frame vent line and a frame relief line, the frame vent line and the frame relief line comprises at least two fluid connectors, each fluid connector connectable to at least one of the first fluid connector of a tank vent line and a tank relief line, and arranged such that at least one of the frame vent line and the frame relief line may be-fluidly connected to the tank vent lines and tank relief lines of the at least two pressure tanks, respectively, when the pressure tanks are mounted upon the base frame side by side.

4. A modular tank system according to claim 1, wherein the at least two fluid connectors of the frame process line, and the first fluid connector of the tank process line, are arranged such that the frame process line is fluidly connected to the tank process line when one of the at least two pressure tanks is mounted upon the base frame.

5. A modular tank system according to claim 1, wherein the frame process line comprises a process line port.

* * * * *